US008850749B2

(12) United States Patent
Sui

(10) Patent No.: US 8,850,749 B2
(45) Date of Patent: Oct. 7, 2014

(54) ADJUSTABLE DESKS AND CHAIRS FOR AUDIOVISUAL CLASSROOMS

(75) Inventor: Li-Hua Sui, Taoyuan County (TW)

(73) Assignee: National Central University, Taoyuan County (TW)

( * ) Notice: Subject to any disclaimer, the term of this patent is extended or adjusted under 35 U.S.C. 154(b) by 126 days.

(21) Appl. No.: 13/008,190

(22) Filed: Jan. 18, 2011

(65) Prior Publication Data

US 2011/0175405 A1 Jul. 21, 2011

(30) Foreign Application Priority Data

Jan. 20, 2010 (TW) ..... 99101465 A

(51) Int. Cl.

| | |
|---|---|
| ***E04B 1/346*** | (2006.01) |
| ***A47C 3/18*** | (2006.01) |
| ***A47C 13/00*** | (2006.01) |
| ***A47C 7/62*** | (2006.01) |
| *A47B 97/00* | (2006.01) |

(52) U.S. Cl.

CPC ... *A47C 7/62* (2013.01); *A47C 3/18* (2013.01); *A47C 13/005* (2013.01); *A47B 97/00* (2013.01)

USPC ..... 52/65; 297/240

(58) Field of Classification Search

CPC .. E04B 1/346; A47B 2083/025; A47B 83/02; A47B 39/00; A47C 3/18

USPC ..... 52/65; 297/172, 174 R, 240

See application file for complete search history.

(56) References Cited

U.S. PATENT DOCUMENTS

| | | | | | |
|---|---|---|---|---|---|
| 1,732,113 | A | * | 10/1929 | Van Der Meer | 248/349.1 |
| 2,894,561 | A | * | 7/1959 | Mackintosh | 297/172 |
| 3,077,038 | A | * | 2/1963 | Williams et al. | 434/310 |
| 3,575,465 | A | * | 4/1971 | Dolby et al. | 297/118 |
| 3,646,896 | A | * | 3/1972 | Derujinsky et al. | 108/139 |
| 3,686,804 | A | * | 8/1972 | Browne | 52/31 |
| 3,778,911 | A | * | 12/1973 | Woolman | 434/432 |
| 3,818,609 | A | * | 6/1974 | Woolman | 434/237 |
| 4,191,437 | A | * | 3/1980 | Funke | 312/305 |
| 4,564,237 | A | * | 1/1986 | Steifensand | 297/423.11 |
| 5,400,550 | A | * | 3/1995 | Beasley | 52/65 |
| 5,452,950 | A | * | 9/1995 | Crenshaw et al. | 312/223.3 |
| 5,533,857 | A | * | 7/1996 | Ferrone | 414/757 |
| 5,653,065 | A | * | 8/1997 | McIlwain | 52/65 |
| 5,755,160 | A | * | 5/1998 | Blufordcraving | 104/36 |
| 6,010,186 | A | * | 1/2000 | Tsay | 297/159.1 |
| 6,039,392 | A | * | 3/2000 | Dencker | 297/172 |
| 6,102,475 | A | * | 8/2000 | Hamann | 297/172 |
| 6,148,568 | A | * | 11/2000 | Beasley | 52/65 |
| 6,474,025 | B1 | * | 11/2002 | Faiks et al. | 52/36.1 |
| 6,851,748 | B1 | * | 2/2005 | Garrick | 297/240 |
| 6,896,330 | B1 | * | 5/2005 | Yu | 297/344.21 |
| 6,996,940 | B2 | * | 2/2006 | Beasley | 52/65 |

(Continued)

*Primary Examiner* — Brian Glessner
*Assistant Examiner* — Joshua Ihezie
(74) *Attorney, Agent, or Firm* — Rosenberg, Klein & Lee

(57) ABSTRACT

The present invention relates to adjustable desks and chairs for audiovisual classrooms. It comprises a turntable, at least a desk and at least a chair. The turntable is installed on the floor of an audiovisual classroom. The desk is installed on the turntable. The chair is installed on the turntable and in proximity to the desk. The turntable can rotate the desk and the chair together to any desired angle, thereby increasing the convenience of using an audiovisual classroom.

12 Claims, 9 Drawing Sheets

(56) References Cited

U.S. PATENT DOCUMENTS

| | | | | |
|---|---|---|---|---|
| 7,048,332 | B1 * | 5/2006 | Dilling | 297/172 |
| 7,980,858 | B2 * | 7/2011 | Valoe et al. | 434/432 |
| 8,505,245 | B2 * | 8/2013 | Bobryshev et al. | 52/64 |
| 2006/0071515 | A1 * | 4/2006 | Mills et al. | 297/160 |
| 2006/0103181 | A1 * | 5/2006 | Dilling | 297/172 |
| 2007/0138843 | A1 * | 6/2007 | Jonsson et al. | 297/157.1 |
| 2007/0182222 | A1 * | 8/2007 | Griepentrog | 297/172 |
| 2007/0267902 | A1 * | 11/2007 | Hill et al. | 297/173 |

* cited by examiner

ADJUSTABLE DESKS AND CHAIRS FOR AUDIOVISUAL CLASSROOMS

BACKGROUND OF THE INVENTION

1. Field of Invention

The present invention relates to desks and chairs for audiovisual classrooms, in particular, adjustable desks and chairs for audiovisual classrooms.

2. Description of Related Art

Along with the development and advancement of electronic technology and internet accessibility, the popularity of computers has increased year by year. As computer usage has become more widespread, computer-aided teaching methods for classes or conferences have also become more popular. Nowadays when facing students or audiences, teachers or speakers often make use of electronic devices other than books or papers, such as computers or projectors, to help with their presentations. As a result, more and more lessons and speeches are conducted in audiovisual classrooms equipped with personal computers or projectors, especially conference rooms or computer classrooms.

Take a computer classroom for example. A typical computer classroom generally has a centralized telecommunicating broadcasting teaching system, in which a controlling teaching device is connected to other controlled learning devices. The controlling teaching device can view pictures as well as receive sound from the controlled learning devices. It can also transmit pictures and sound to one or more controlled learning devices of the teacher's choosing. Therefore, teachers can achieve their goals of teaching and training students by using the computer-aided multimedia teaching and training system.

However, in a typical computer classroom, the controlling teaching device is usually set up at the teacher's desk in front of the classroom, whereas the student desks are set up in rows perpendicular to the teacher's desk, facing the middle of the room. The controlled learning devices are the computers on top of the student desks. It is very convenient if the teacher limits his/her teaching repertoire to the use of the controlling teaching device. It is less convenient if the teacher determines to use different way of teaching, such as writing on the whiteboard or conducting group discussions. If the whiteboard is being used, the students have to turn their heads in order to see the writing on the whiteboard, since the whiteboard is perpendicular to the direction their desks face. This is very uncomfortable for students' necks. There are some computer classrooms in which student desks are arranged to face the whiteboard. They allow more comfortable and adequate viewing of the teacher and the whiteboard, but are less flexible for group discussions and student interactions. If the classroom layout and configuration is adjustable, the teacher-to-student or student-to-student interactions will be enhanced.

Due to the above shortcomings, the present invention presents adjustable desks and chairs for audiovisual classrooms. The direction of the desks and chairs can be adjusted in order to increase the flexibility of using an audiovisual classroom and resolve audiovisual classroom seating arrangement issues.

SUMMARY OF THE INVENTION

The main purpose of the present invention is to present adjustable desks and chairs for audiovisual classrooms. It rotates at least a desk and at least a chair together to any desired angle by a turntable that increases the convenience of using an audiovisual classroom.

The adjustable desks and chairs for audiovisual classrooms in the present invention comprise a turntable, at least a desk and at least a chair. The turntable is installed on the floor of an audiovisual classroom. The desk is installed on the turntable. The chair is installed on the turntable and in proximity to the desk. The turntable can rotate the desk and the chair together to any desired angle that increases the convenience of using the audiovisual classroom.

BRIEF DESCRIPTION OF THE DRAWINGS

The structure and the technical means adopted by the present invention to achieve the above and other objectives can be best understood by referring to the following detailed description of the preferred embodiments and the accompanying drawings, wherein.

DETAILED DESCRIPTION OF THE PREFERRED EMBODIMENT

Figure 1:
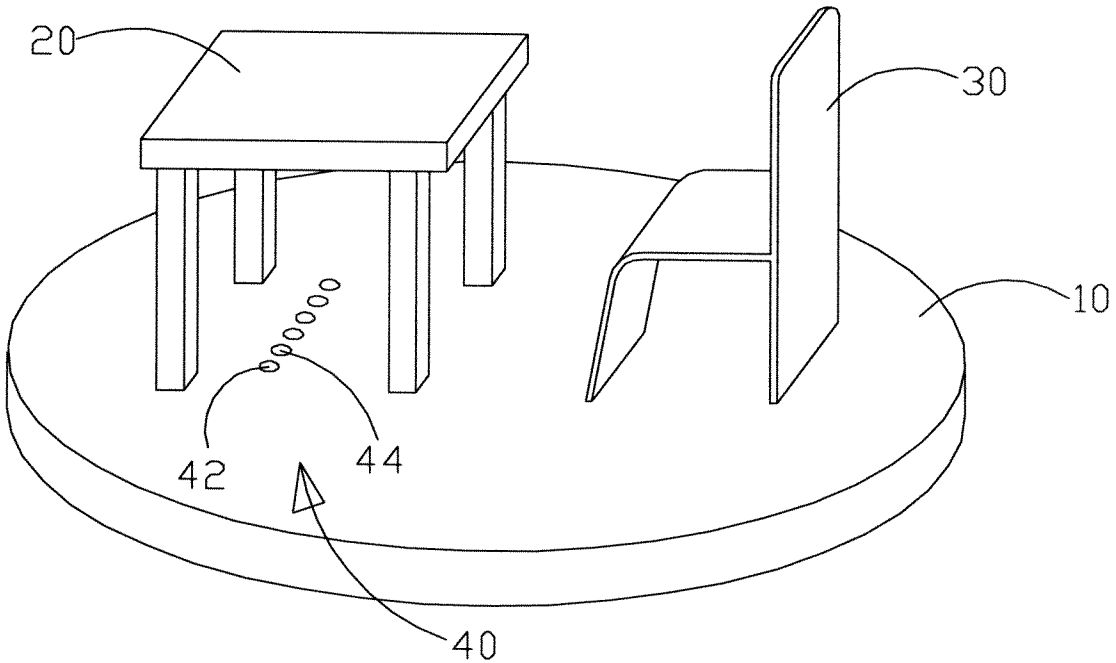
FIG. 1 is a perspective view showing the structure of a preferred embodiment of the present invention.

The substances, the technical contents, and the expected effectiveness of the present invention will become more apparent from the detailed description of preferred embodiments in conjunction with the accompanying drawings as follows:

FIG. 1 is a perspective view of a preferred embodiment of the present invention. As shown, the adjustable desks and chairs of audiovisual classrooms of the present invention comprise a turntable 10, at least a desk 20 and at least a chair 30. Said turntable 10 is installed on the floor of an audiovisual classroom. Said desk 20 is installed on said turntable 10. Said chair 30 is installed on said turntable 10 and in proximity to said desk 20. This embodiment is described with the example of desk 20 and chair 30 for single-person usage. Said desk 20 can be for multiple persons' usage, such as a desk for three persons that is matched with three chairs 30. The present invention rotates said desk 20 and said chair 30 together to any desired angle by said turntable 10 that increases the convenience of using an audiovisual classroom.

For further increasing the convenience of the present invention, a plurality of connection ports 40 is installed on said turntable 10. Said connection ports 40 include a power connection port 42 and signal connection ports 44. Therefore external power or signals can be connected through said connection ports 40. Said signal connection ports 44 include a network signal connection port, a video signal connection port and an audio signal connection port. The external power or signals are connected to said turntable 10 through said connection ports 40. Therefore users can set up computers or other electronic devices on said desk 20, and connect computers or other electronic devices to said power connection port 42 so that external power is supplied to said computer or other electronic devices through said power connection port 42. External signals are connected to said computer or other electronic devices through said signal connection ports 44 so that signals from said computer or other electronic devices can be transmitted through said signal connection ports 44.

Figure 2A:
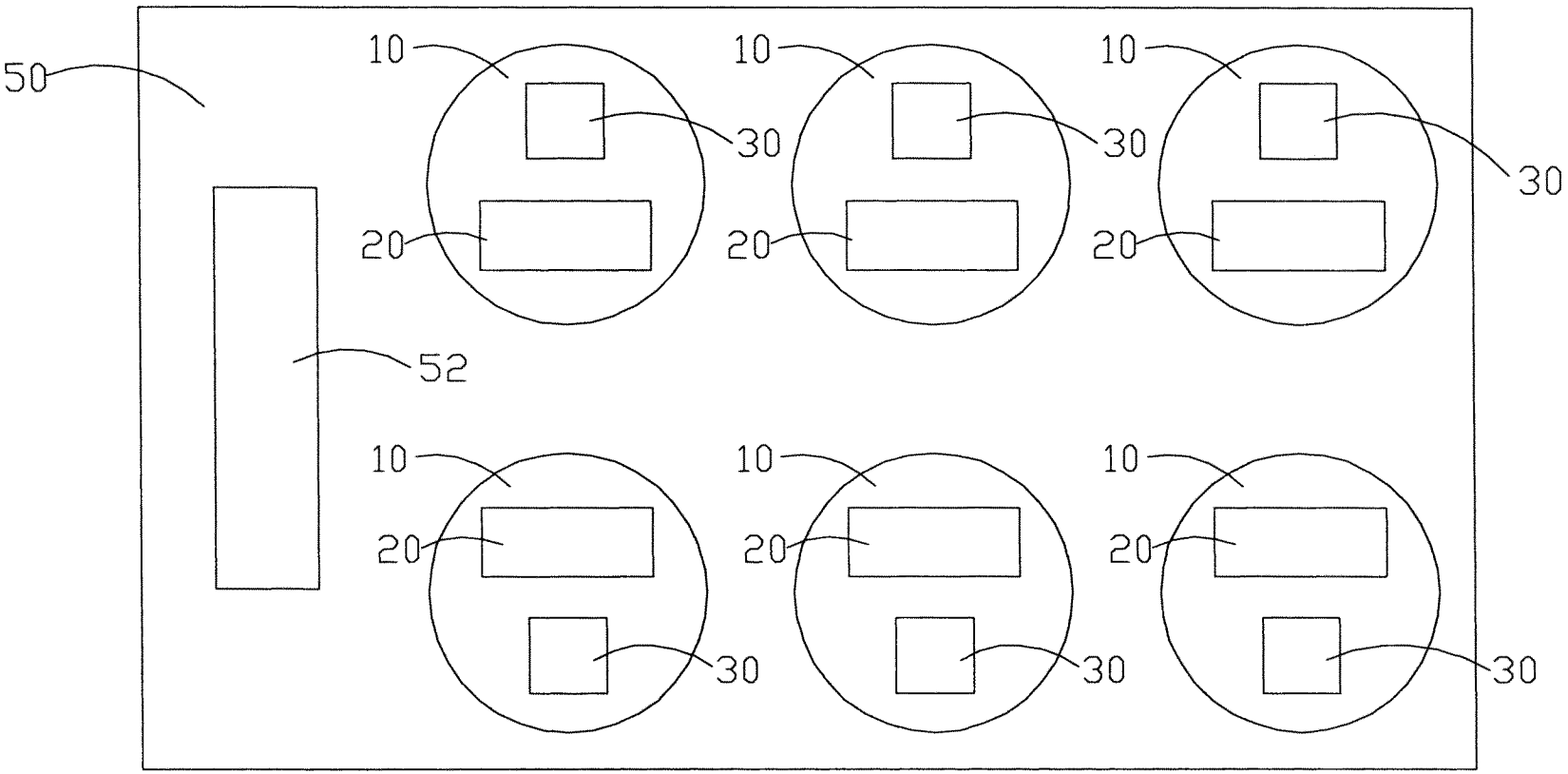
FIG. 2A is a floor plan showing an application configuration of a preferred embodiment of the present invention.
Figure 2B:
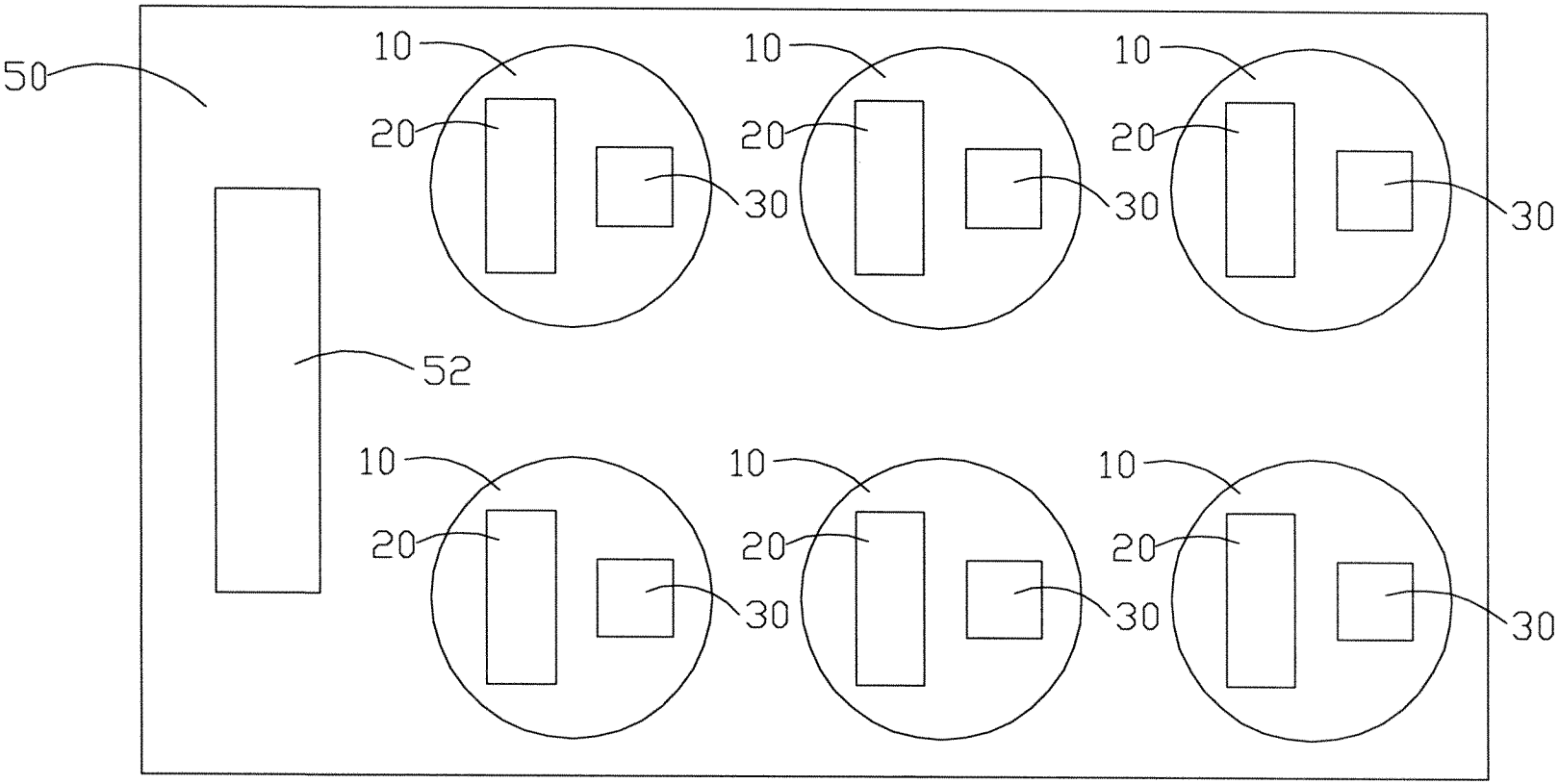
FIG. 2B is a floor plan showing another application configuration of a preferred embodiment of the present invention.
Figure 2C:
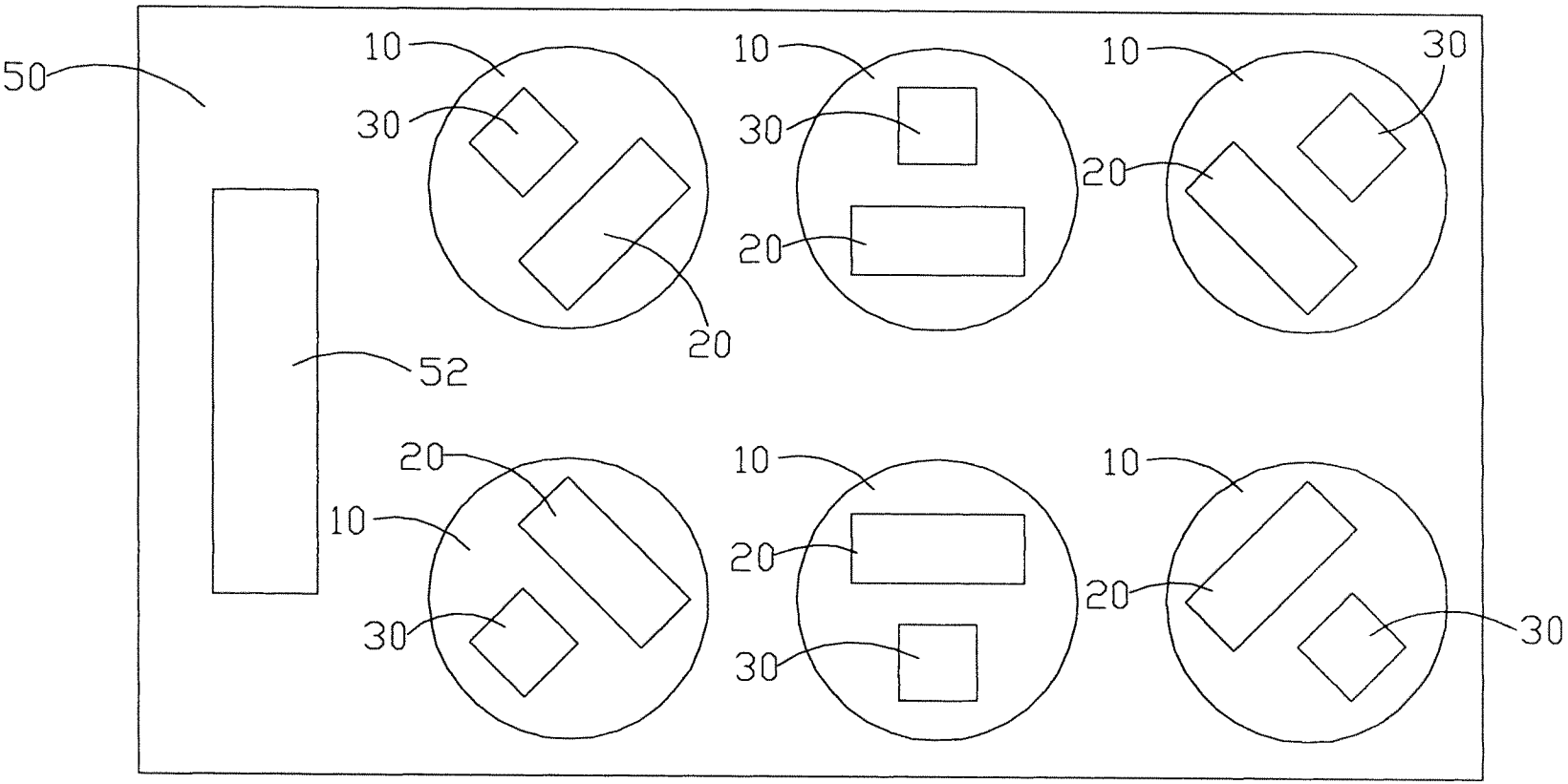
FIG. 2C is a floor plan showing another application configuration of a preferred embodiment of the present invention.

Please see FIGS. 2A, 2B and 2C. They are floor plans of a preferred embodiment of the present invention of adjustable desks and chairs for audiovisual classrooms. As shown, the adjustable desks and chairs for an audiovisual classroom are set up in said audiovisual classroom 50. There is a podium 52 in said audiovisual classroom 50. Said podium 52 is where the teacher is positioned to teach. The common arrangement of desks 20 and chairs 30 in said audiovisual classroom 50 is as shown in FIG. 2A. Desks 20 are divided into two groups that face each other. Therefore desks 20 and chairs 30 are facing the centerline of said audiovisual classroom 50 when students use desks 20 and chairs 30. For the convenience of students to face said podium 52, turntables 10 are rotated that all desks face said podium 52 as shown in FIG. 2B. For the convenience of group discussions, said turntables 10 are rotated that all students face the center of said audiovisual classroom 50 as shown in FIG. 2C. Even though only six sets of desks and chairs are used as an example in this embodiment, the number of sets of desks and chairs can be as required for the real situation.

Figure 3:
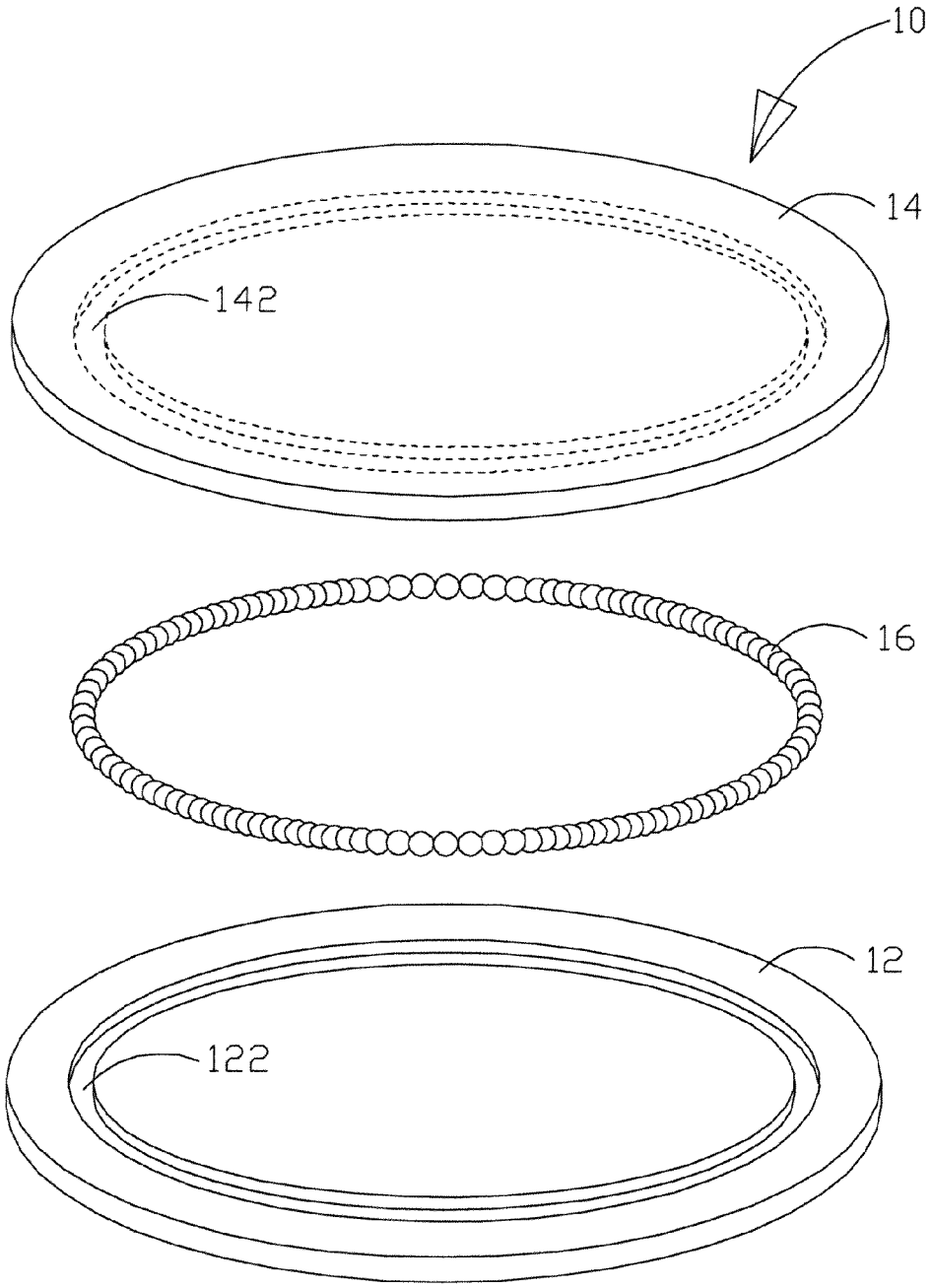
FIG. 3 is a perspective exploded view showing the structure of a turntable of a preferred embodiment of the present invention.

FIG. 3 is an exploded perspective view of a turntable 10 of a preferred embodiment of the present invention. As shown, said turntable 10 of the present invention comprises a stator 12, a rotor 14 and a slider 16. Said stator 12 is installed on the floor. Said rotor 14 is installed above said stator 12. At least a desk 20 and at least a chair 30 are installed on said rotor 14. Said slider 16 is installed between said rotor 14 and said stator 12. Said slider 16 of this embodiment consists of a plurality of balls. A groove 122 is provided on the top side of said stator 12. Another groove 142 is provided on the bottom side of said rotor 14, which matches said groove on the top side of said stator. Said balls are held between said two grooves 122 and 142. With said balls, the friction between said rotor 14 and said stator 12 is reduced that said rotor 14 can rotate more easily.

Figure 4:
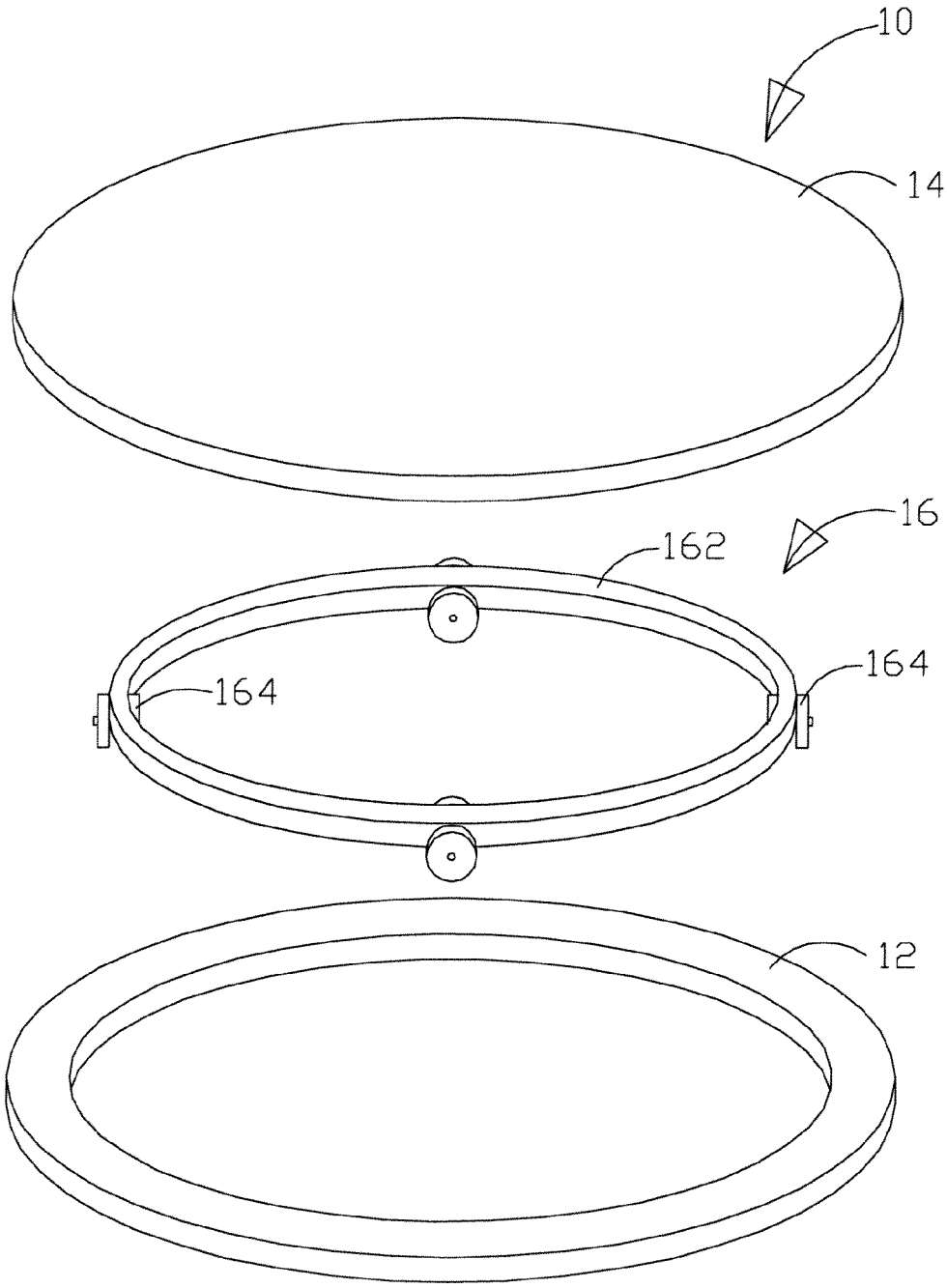
FIG. 4 is a perspective exploded view showing the structure of a turntable of another preferred embodiment of the present invention.

FIG. 4 is an exploded perspective view of a turntable 10 of another preferred embodiment of the present invention. As shown, said turntable 10 of this embodiment also comprises a stator 12, a rotor 14 and a slider 16. The difference between this embodiment and the previous embodiment is in said slider 16: said slider 16 of the previous embodiment uses balls to reduce the friction between said rotor 14 and said stator 12; said slider 16 of this embodiment comprises a first rim 162 installed under said rotor 14 and a plurality of wheels 164 installed outside said first rim 162. Said stator 12 of this embodiment constitutes a second rim. Said first rim 162 and said stator 12 (said second rim) are two circular rims that match each other in shape. Two said rims can be fixed to each other or connected to each other by frictional contact that, when said rotor 14 rotates, said rotor 14 can drive said first rim 162 to rotate. Said first rim 162 rotates by said wheels 164. Said first rim 162 will rotate inside said second rim 12. Said second rim 12 can constrain said first rim 162 that said rotor 14 won't shift when it rotates.

Figure 5:
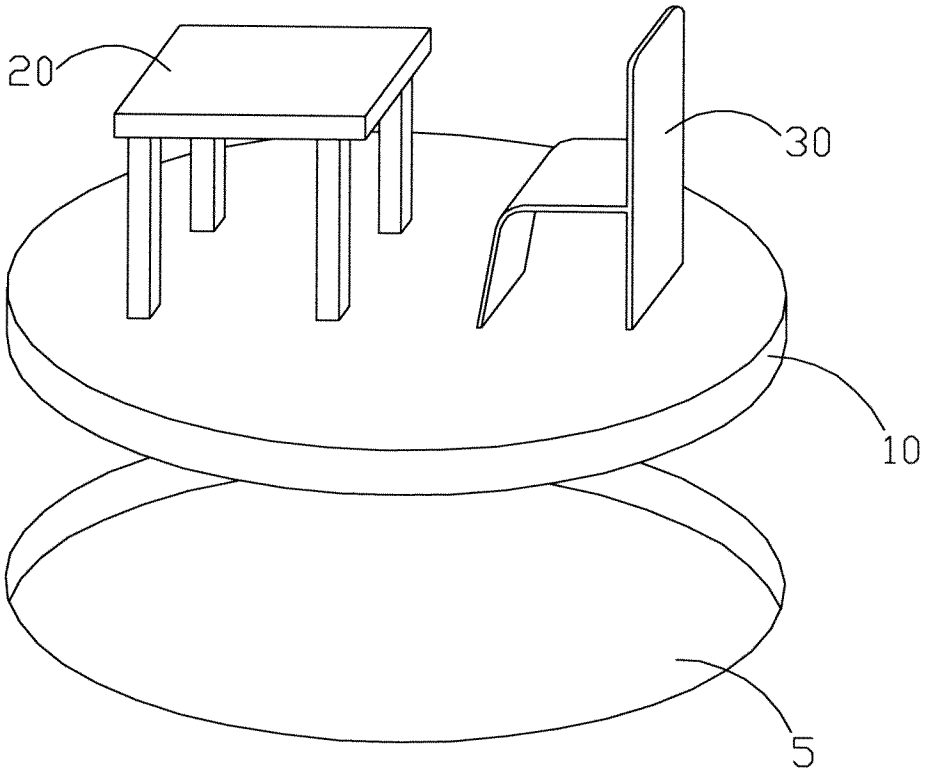
FIG. 5 is a perspective partially-exploded view showing the structure of another preferred embodiment of the present invention.

FIG. 5 is a perspective partially-exploded view of a turntable of a preferred embodiment of the present invention. As shown, a recess 5 is provided on the floor. Said turntable 10 is installed in said recess 5. Said turntable 10 is seated in said recess 5 such that the top surface of said turntable 10 is level with the floor. Therefore the desks 20 and the chairs 30 can be used without said turntable 10 protruding from the floor.

Figure 6:
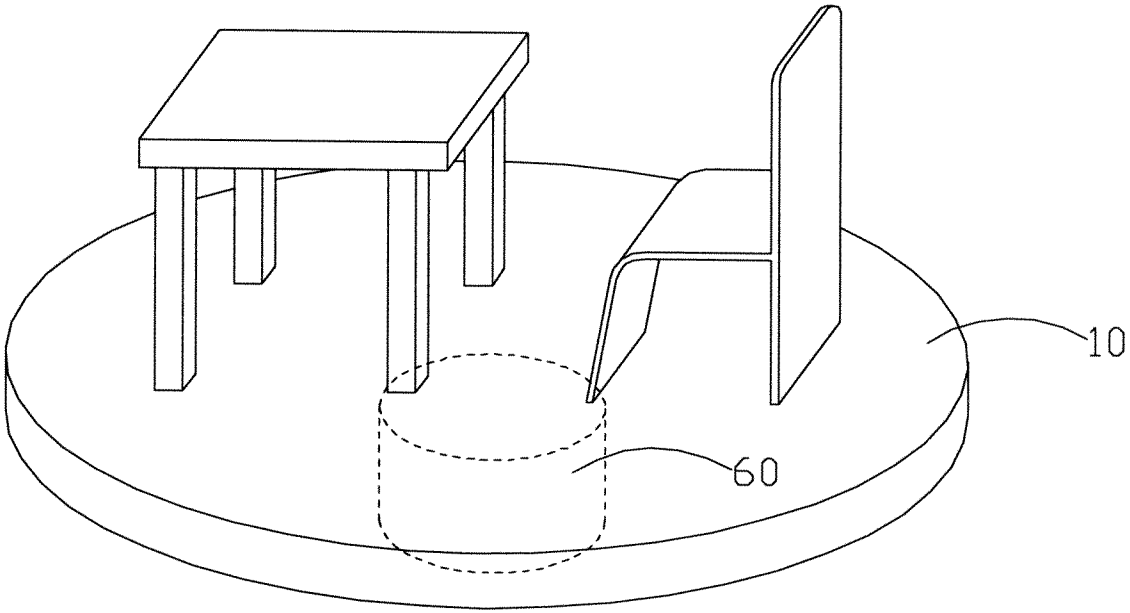
FIG. 6 is a perspective view showing the structure of another preferred embodiment of the present invention.

FIG. 6 is a perspective view of a desk and a chair of an adjustable audiovisual classroom of another preferred embodiment of the present invention. As shown, the present invention further comprises a driving device 60. Said driving device 60 is installed in contact to a turntable 10. Said driving device 60 can be a motor. In the present invention, said driving device 60 can drive said turntable 10 by gears or chain. Using said driving device 60 to drive said turntable 10 makes it easier to rotate said turntable 10 so that the present invention becomes easier to implement.

Figure 7:
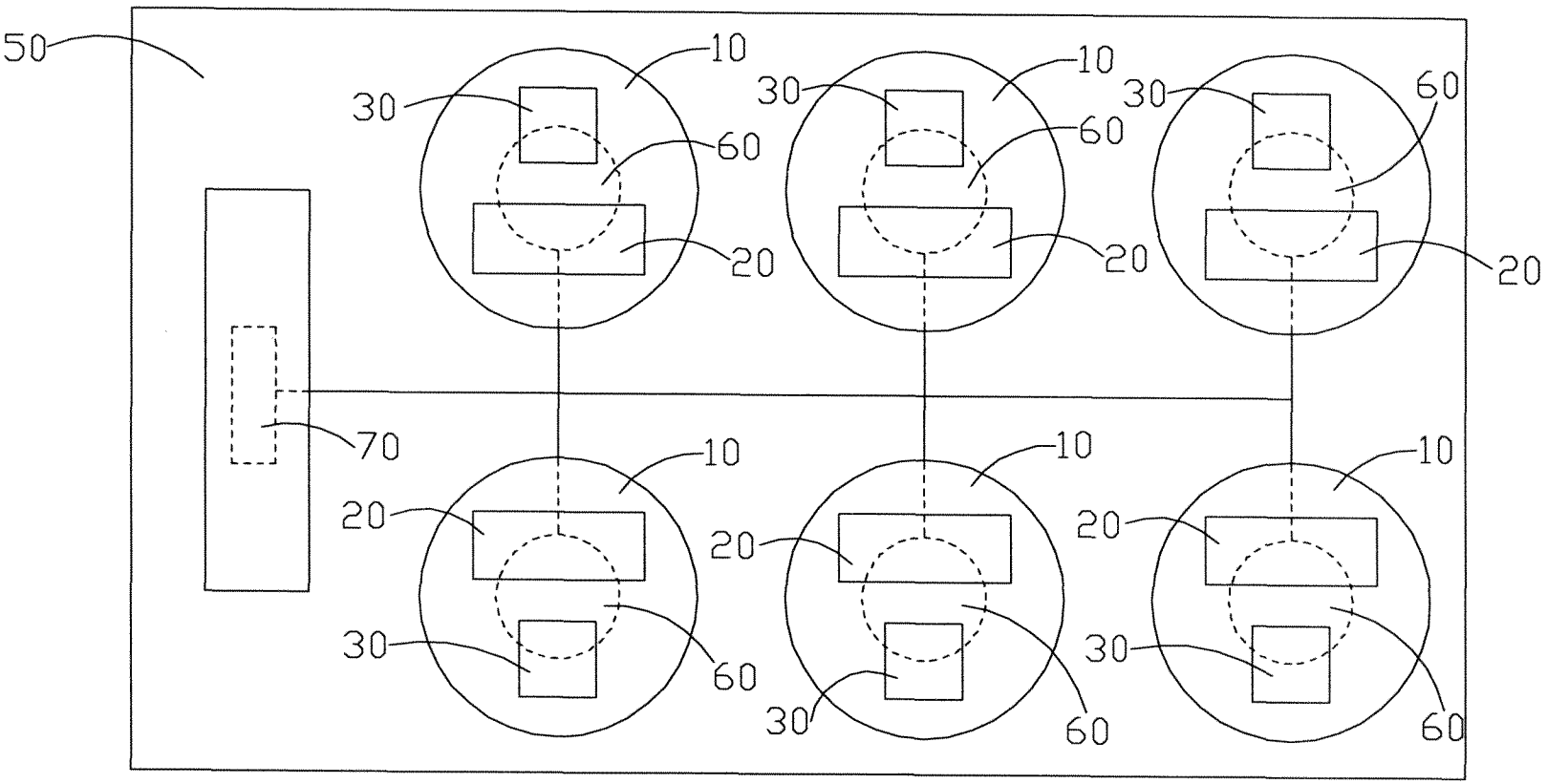
FIG. 7 is a floor plan showing an application configuration of another preferred embodiment of the present invention.

FIG. 7 is a floor plan of desks and chairs in an audiovisual classroom of another preferred embodiment of the present invention. As shown, the difference between this embodiment and the previous embodiment is that this embodiment comprises a controlling device 70. Said controlling device 70 is connected to said driving device 60 electrically. Said controlling device 70 can adjust the driving amplitude of said driving device 60 that controls the rotating angle of said turntable 10 to rotate the desks 20 and chairs 30 in an audiovisual classroom 50 to the adjusted angles. Or, each driving device 60 is controlled by a controller (not shown). Said controller is individually installed on each desk for free and flexible adjustment individually.

Said controlling device 70 can not only adjust the driving amplitude of said driving device 60, but it also communicates with the controlled computer on said desk 20. For example, a teacher can use said controlling device 70 while students use said controlled computers on said desks 20 in such as way that said controlling device 70 can be connected to a plurality of controlled computers. Said controlling device 70 at the signal-sending terminal sends command signals to said controlled computers at the signal-receiving terminal through a network interface when controlling device 70 communicates to said controlled computers. When said controlling device 70 and controlled computers transmit monitor signals to each other, the signal-sending terminal communicates multimedia signals through multimedia interface to the signal-receiving terminal.

Said controlling device 70 consists of a network interface card, personal computer, control monitor, multimedia transmitter, etc. Said controlling device 70 consists of some internal interfaces, such as the wiring connecting a personal computer and a control monitor, the wiring connecting a personal computer and multimedia transmitters, the wiring connecting a personal computer and a network interface card (NIC), and the wiring connecting a control monitor and multimedia transmitters. The network interface can use the well-known IPX (Internet Packet Exchange), NDIS (Network Driver Interface Specification) or Packet Driver standards to communicate signals between said controlling device 70 and controlled computers.

A controlled computer consists of a network interface card, personal computer, controlled-end control box and multimedia transmitter. The controlled computer consists of some internal interfaces, such as the wiring connecting a personal computer and a controlled-end control box, and the wiring connecting a personal computer and a multimedia transmitter, and the wiring connecting a personal computer and a network interface card (NIC).

As described above, the present invention of adjustable desks and chairs for audiovisual classrooms comprise a turntable, at least a desk and at least a chair. Said desk and chair are installed on said turntable. Said turntable can turn said desk and chair to any desired angle to increase the convenience of using an audiovisual classroom.

What is claimed is:

1. A rotatable device with adjustable desks and chairs for audiovisual classrooms, comprising:

a plurality of turntables fully installed on a plurality of recesses provided on a floor, whereby each turntable is installed in a respective recess, the turntables comprising:

a stator installed in each of the recesses of the floor;

a rotor installed above each of the stators respectively, the chairs and the desks installed on the rotors, respectively; and a slider installed between each of the rotors and the stators respectively;

a desk directly and fixedly installed on each of the plurality of turntables; and a chair directly and fixedly installed on each of the plurality of turntables, and the chair on each turntable being disposed in proximity to a corresponding desk thereon, each of the turntables rotating together with a respective chair and corresponding desk fixedly installed thereon, one of the chairs and one of the desks installed on one of the turntables facing one direction;

wherein the chairs and the desks are separate from each other, the plurality of turntables being rotatable to selected orientations and dividable into groups wherein each group faces a common location, the turntables of each group being rotated to a common selected orientation such that each chair of the group faces the selected common location.

2. The rotatable device with adjustable desks and chairs for audiovisual classrooms in accordance with claim 1, wherein each of the sliders consists of a plurality of balls; a groove is provided on a top side of said stator; another groove is provided on a bottom side of said rotor which matches said groove on the top side of said stator, and the balls held between said two grooves.

3. The rotatable device with adjustable desks and chairs for audiovisual classrooms in accordance with claim 1, wherein said slider comprises: a first rim installed under said rotor and a plurality of wheels installed outside said first rim, said stator defining a second rim and said first rim being located inside said second rim.

4. The rotatable device with adjustable desks and chairs for audiovisual classrooms in accordance with claim 1, further comprising:

a plurality of driving devices, each of the plurality of driving devices being installed in contact with a respective one of the plurality of turntables.

5. The rotatable device with adjustable desks and chairs for audiovisual classrooms in accordance with claim 4, wherein said driving device comprises a motor, said motor driving said rotor by gears or chain.

6. The rotatable device with adjustable desks and chairs for audiovisual classrooms in accordance with claim 4, further comprising a controlling device, said controlling device being connected to said driving device electrically.

7. The rotatable device with adjustable desks and chairs for audiovisual classrooms in accordance with claim 1, further comprising a plurality of connection ports installed on the turntables.

8. The rotatable device with adjustable desks and chairs for audiovisual classrooms in accordance with claim 7, wherein one of said connection ports is a power connection port.

9. The rotatable device with adjustable desks and chairs for audiovisual classrooms in accordance with claim 7, wherein said connection ports include signal connection ports.

10. The rotatable device with adjustable desks and chairs for audiovisual classrooms in accordance with claim 9, wherein one of said signal connection ports is a network signal connection port.

11. The rotatable device with adjustable desks and chairs for audiovisual classrooms in accordance with claim 9, wherein said signal connection ports include a video signal connection port.

12. The rotatable device with adjustable desks and chairs for audiovisual classrooms in accordance with claim 9, wherein one of said signal connection ports is an audio signal connection port.

* * * * *